United States Patent [19]

Calleance

[11] 4,193,151

[45] Mar. 18, 1980

[54] WATERBED SAFETY LINER

[76] Inventor: David Calleance, 1945 - 23rd Ave., San Francisco, Calif. 94116

[21] Appl. No.: 927,299

[22] Filed: Jul. 24, 1978

[51] Int. Cl.[2] ..... A47C 27/08

[52] U.S. Cl. ..... 5/452; 5/455

[58] Field of Search ..... 5/365, 367, 368, 370, 5/371, 349, 350, 369, 452, 451, 435

[56] References Cited

U.S. PATENT DOCUMENTS

| | | | |
|---|---|---|---|
| 4,064,579 | 12/1977 | Winther | 5/452 |
| 4,079,473 | 3/1978 | Phillips | 5/452 |
| 4,100,635 | 7/1978 | Mitchell et al. | 5/452 |

*Primary Examiner*—Alexander Grosz

[57] ABSTRACT

An improved waterbed safety liner includes a base sheet which underlays the watermattress, and sidewalls extending upwardly from the edges of the base sheet to surround the watermattress and contain any liquid leaking therefrom. In one embodiment, an inflatable air chamber is integrally formed with the upper extent of the sidewalls to overlay a portion of the watermattress and provide buoyant edge support thereon. In another embodiment, a chamber formed integrally with the sidewalls of the safety liner are equal in height to the height of the watermattress, and are inflated either with air or with resilient foam material.

9 Claims, 5 Drawing Figures

WATERBED SAFETY LINER

BACKGROUND OF THE INVENTION

In the past several years, waterbeds and similar flotation sleeping devices have undergone a transformation from an esoteric, highly specialized item to a product line which has gained wide acceptance with the purchasing public At the same time, waterbeds have evolved from fairly simple constructions, i.e., a watermattress surrounded by a safety liner supported in a low plank frame, to very sophisticated constructions which employ interior air chambers, baffle panels, gel-like liquid substances, and the like. These new constructions have increased the comfort and desirability of using waterbeds, and are largely responsible for the increased public acceptance of waterbeds.

The increased complexity of watermattress construction has resulted in greater production costs and fabrication problems. For example, the watermattresses which includes interior baffle panels often require a great amount of labor to effect the interior seams which secure the baffle panels within the mattress. Likewise, watermattress constructions which include interior air chambers for buoyant edge support also require more effort and skill to form the greater number of seams which are required.

Most of the effort directed toward improving waterbeds in recent years has involved improvements in the watermattress itself. At the same time, however, the standard frame and safety liner are still required to support the liquid filled mattress and to contain any liquid which might leak therefrom. Very little developmental effort has been direct toward the safety liner itself. The safety liner could be improved to permit the use of a simpler, less expensive watermattress than those now found on the market. By reducing the number of complicated, interior seams, it might well be possible to reduce the overall costs of the waterbed construction.

SUMMARY OF THE PRESENT INVENTION

The present invention generally comprises an improved waterbed safety liner which is designed specifically to provide edge support for an individual sitting or reclining on the edge of a waterbed. The safety liner surrounds the bottom and sides of the watermattress to retain any water which leaks from the watermattress. By combining the well-known water retaining feature with the edge support function, the present invention permits the use of an simple waterbag to achieve a comfortable waterbed construction which is easy and inexpensive to manufacture and sell.

The invention includes a base sheet of polyvinyl or similar material which is disposed beneath the watermattress of a typical waterbed. Joined to the edges of the base sheet are sidewalls which are joined at their ends to form a continuous coffer with the base sheet. The sidewalls are also formed of polyvinyl or similar material, and the coffer is adapted to contain any water which leaks from the watermattress disposed therein.

A unique feature of the present invention is the provision of an inflated chamber which is formed integrally with the sidewalls of the liner, the chamber extending continuously about the inner surface of the sidewalls. In one embodiment, the chamber is formed at the upper extremity of the sidewalls, so that the chamber overlays a portion of the watermattress disposed therebelow. The chamber is inflated with air to provide buoyant support for an individual sitting or reclining on the edge of the bed.

In another embodiment of the invention, the chamber formed integrally with the sidewalls of the liner extends substantially the full depth of the watermattress. The chamber may be inflated with air, or may be filled with a resilient foam material. Either embodiment may be used in conjunction with the simplest, least expensive form of watermattress, while providing the highly desirable feature of firm edge support.

The safety liner of the present invention is adapted to be retained within a simple rectangular frame. Unlike safety liners known in the prior art, the present invention need not be mechanically secured to the interior surface of the frame. The present invention is relatively freestanding within the frame, so that sheets, blankets, or bedspreads may have their edge portions tucked into the space between the exterior of the safety liner and the interior of the bed frame.

A BRIEF DESCRIPTION OF THE DRAWING

DESCRIPTION OF THE PREFERRED EMBODIMENT

Figure 1:
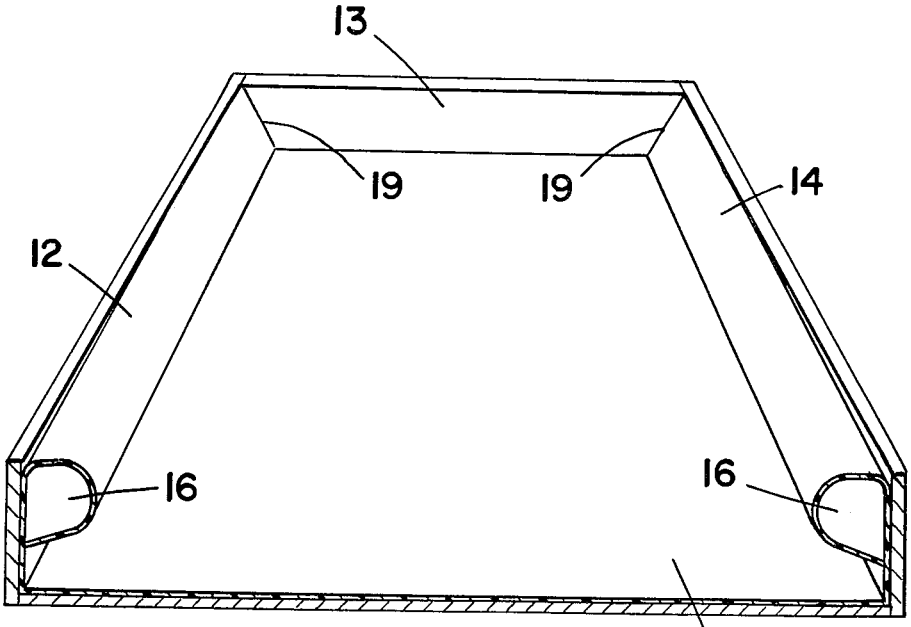
FIG. 1 is a perspective view of one embodiment of the safety liner of the present invention.

The present invention generally comprises a safety liner, for use in a waterbed, which is adapted to provide edge support for individual sitting or reclining on the bed, as well as providing the safety feature of retaining any liquid which leaks from the watermattress disposed within the safety liner. As shown in FIG. 1, the present invention includes a base sheet 11, and sidewalls 12, 13, and 14 extending upwardly from the edges of the base sheet 11. In the view of FIG. 1, one of the sidewalls is not shown. The four sidewalls and the base sheet 11 are sealed at their adjoining edges to define a coffer which contains the watermattress and any liquid which might leak therefrom. The safety liner is shown disposed within a waterbed frame, which is a rectangle formed of suitable planks joined at confronting ends to define an enclosure which provides lateral support to the safety liner and to the watermattress. Of course, other shapes and configurations of waterbeds and frames are within the scope of the present invention.

Figure 2:
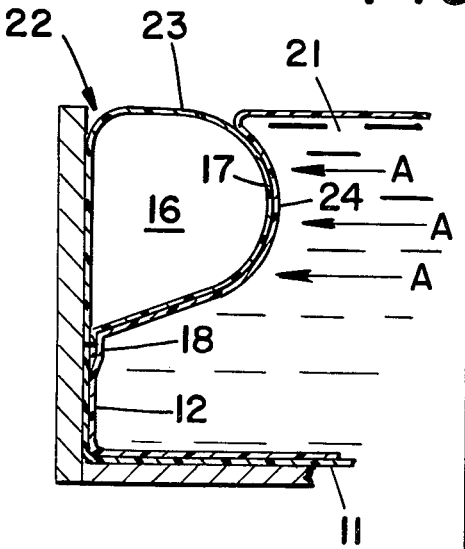
FIG. 2 is an enlarged cross-sectional elevation of one embodiment of the present invention.

A salient feature of the present invention is the provision of an inflatable chamber 16 which is joined to the upper portion of the sidewalls and which extends in continuous fashion about the inner periphery of the safety liner. As shown in FIG. 2, one embodiment of the safety liner is constructed with the chamber 16 formed integrally with the sidewalls of the liner. That is, the panels which form the sidewalls of the safety liner are greater in height than the depth of the waterbed frame, and the excess height portion 17 is folded inwardly back on itself and joined thereto by a seam 18. The sidewall panels also are each joined to the abutting end portions of the others by seams 19 to form a coffer which contains the watermattress and also a continuous chamber 16 disposed therein and circumscribing the upper edge portion of the watermattress. It is within the scope of the invention to fold the portions 17 outwardly and back on itself to form the chamber 16 with the seam 18.

As shown in FIG. 2, the chamber 16 is substantially surrounded on two sides by the liquid filled watermattress 21. This configuration creates a very substantial buoyant effect which acts vertically upwardly on the chamber 16 and also on the sidewalls of the safety liner. This buoyant force maintains the safety liner with the sides thereof in their coffer configuration, without the need of any mechanical vertical support from the frame of the watermattress. For this reason, no mechanical connections are required between the safety liner of the present invention and the frame of the waterbed.

The lack of mechanical connections between the safety liner and the frame results in oe of the salient advantages of the construction of the present invention. That is, the sheets, pads, blankets, or bedspreads which are used in conjunction with the waterbed may have their edge portions tucked into the space 22 extending between the outer surface of the safety liner and the inner surface of the frame of the waterbed. The sheets, blankets, and the like will be retained in this space by the clamping effect of the outward hydraulic pressure of the watermattress acting on the safety liner and opposed by the rigid frame. Regardless of any wave motion within the watermattress 21, a sufficient outward hydraulic pressure will be exerted on the chamber 16 and the sidewall to maintain the sheets and the like tightly secured in the space 22.

Another significant advantage of the present invention is also due to the buoyant effect exerted on the chamber 16. Because the chamber 16 is inflated by air pressure introduced through a valve (not shown), it forms an inflated tube which has sufficient rigidity to support without collapsing the weight of a person sitting or reclining thereon. Furthermore, the buoyant force exerted on the tube by the watermattress maintains the upper lateral surface of the tube substantially co-planar with the upper surface of the mattress, even when the inflated tube is supporting the weight of a person. Thus, the inflated chamber 16 forms a broad seating area 23 extending continuously about the periphery of the watermattress 21. The inflated chamber 16 also prevents a reclining, sleeping individual from inadvertently rolling into contact with the hard edge of the frame itself.

It should also be noted that the inwardly facing portion 24 of the chamber 16 forms a convex surface which is in intimate contact with the upper edge extent of the mattress 21. Any wave portion propagating through the water filling the mattress 21, as symbolized by the arrows A in FIG. 2, will be dispersed by the convex reflecting surface 24 of the chamber 16. In this manner any large amplitude wave motion propagating through the watermattress will be quickly attenuated and controlled by the dispersing reflections from the chamber 16.

Thus the present invention generally provides the following improvements in comfort and convenience to a simple, sealed bladder watermattress: a broad seating area at the periphery of the bed, a convenient place to tuck the sheets, blankets, and the like, a buffer to prevent contact with the hard edge of the frame of the bed, and an effective means of attenuating wave motion within the watermattress.

It should be noted that although the level of the broad seating area 23 is shown in FIG. 2 to be generally coplanar with the upper surface of the watermattress 21, it is apparent that the sidewalls may be slightly greater in height so that the seating area 23 is slightly higher than the edge of the frame and the upper surface of the watermattress. This configuration may result in greater seating comfort and a more pronounced buffer effect with respect to the edge of the bed frame.

Figure 3:
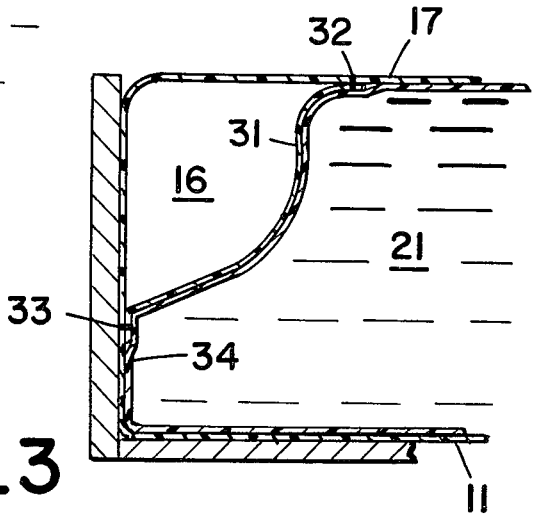
FIG. 3 is an enlarged cross-sectional elevation of another embodiment of the present invention.

With reference to FIG. 3, another embodiment of the present invention also provides a continuous, pneumatically inflated chamber 16 extending about the upper edge portion of the watermattress 21. In this embodiment, the excess height portion 17 of the sidewalls extends generally horizontally over a lateral portion of the upper surface of the watermattress 21. A panel 31 is joined by continuous seams 32 and 33 to the portion 17 and a lower side portion 34 of the sidewall to define the sealed chamber 16.

The embodiment depicted in FIG. 3 exhibits all of the salient benefits enumerated in the foregoing with respect to the embodiment of FIGS. 1 and 2. Further, the embodiment of FIG. 3 exhibits the added benefit afforded by the edge portion 17 which overlays the top surface of the watermattress 21; that is, there is no palpable gap extending between the safety liner and the watermattress itself. The construction shown in FIG. 3 prevents anything from entering between the confronting portions of the safety liner and the watermattress.

Figure 4:
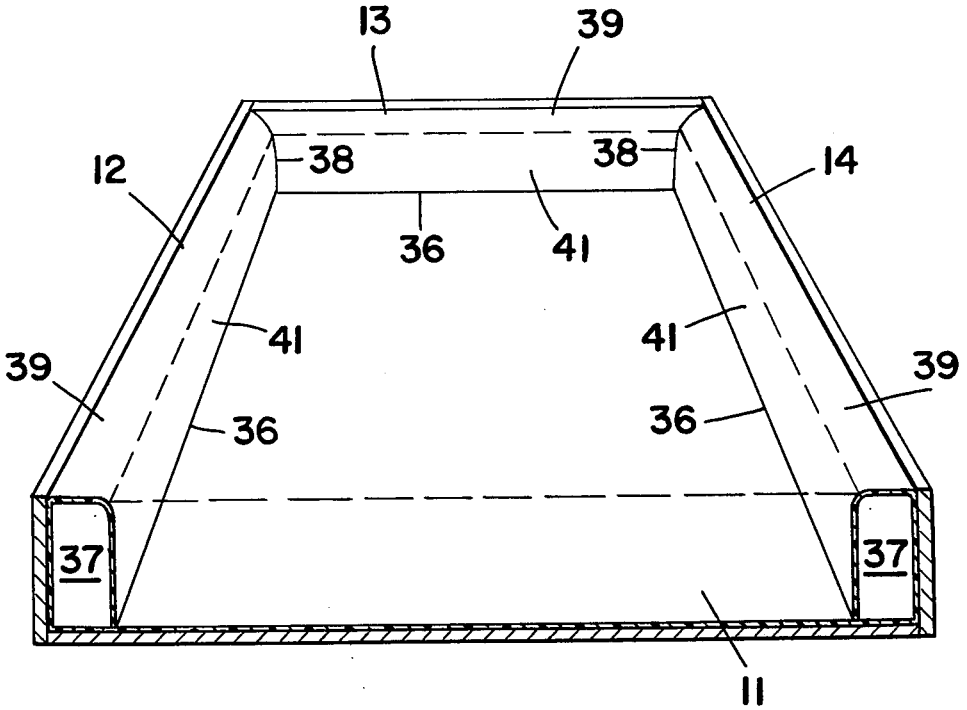
FIG. 4 is a perspective view of a further embodiment of the present invention.

With reference to FIG. 4, another embodiment of the present invention also includes an inflated chamber extending continuously about the periphery of the safety liner to define a coffer containing a watermattress. In this embodiment however, the panels which extend upwardly from the edges of the base sheet 11 have their distal edge portions folded inwardly and downwardly, and are joined by a continuous seam 36 to the base sheet 11. The seam 36 thus forms a sealed cavity 37 extending continuously about the interior of the safety liner to define the coffer which contains the watermattress. The panel sections are also joined at their confronting ends by seam 38 to form the continuous chamber 37. As before, the sidewall panels could be folded outwardly and downwardly to form the cavity 37.

The sealed chamber 37 may be pneumatically inflated through a valve (not shown) to a pressure sufficient to support the weight of an individual resting on the upper surface of the chamber 37. In this manner a broad seating area 39 is formed about the periphery of the safety liner, directly adjacent to the edge of the watermattress. The broken line of FIG. 4 denotes the upper, outer edge of a watermattress disposed within the safety liner. In this embodiment, the hydraulic pressure within the watermattress acting outwardly on the inflated chamber 37 will augment the pneumatic inflation thereof to provide firm support by the inflated chamber. It may be appreciated that the hydraulic pressure of the mattress will cause the inner walls 41 of the chamber 37 to bow inwardly to some extent.

Figure 5:
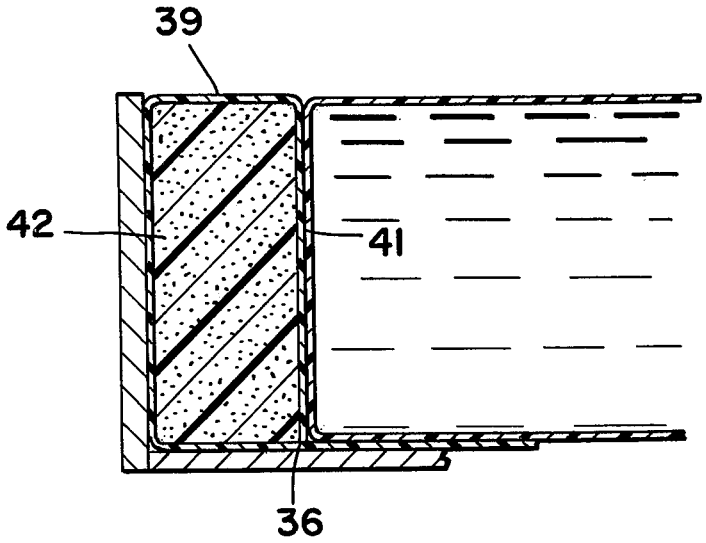
FIG. 5 is an enlarged cross-sectional elevation of yet another embodiment of the safety liner of the present invention.

As shown in FIG. 5, the embodiment of FIG. 4 may be modified by inflating the chamber 37 with a resilient foam substance 42. The foam substance 42 may be introduced into the cavity 37 in shredded form, or in granules, or in sheet form. When foam in any of these forms is used to inflate the chamber 37, there is no need for the chamber to be continuously sealed about the periphery of the liner. Alternatively, the foam material may be introduced into the cavity 37 as a reactive liquid which expands to fill the cavity as it reacts. In any case, the foam material provides firm edge support for the mattress without reliance upon pneumatic inflation to maintain that support.

The foam material which fills the chamber 37 may comprise styrofoam, polyfoam, or polurethane foam. Since the foam material is self supporting and the chamber need not be completely sealed, further chambers 37 may be disposed within the coffer; i.e., a chamber 37 may extend intermediately along the length of the bed to separate the bed into two separate coffers containing two separate watermattresses.

It should be noted that the present invention generally increases the comfort and convenience of an unadorned watermattress, one which comprises a simple sealed bladder containing water. The construction of the present invention is simple and straight forward, requiring simple external seams to effect construction thereof. Likewise, the simple watermattress bladder is also very simple to construct. By combining the present invention with a basic watermattress, the comfort and convenience of highly specialized, complicated watermattresses of intricate construction may be emulated or surpassed.

I claim:

1. In a waterbed including a liquid filled bladder disposed within a supporting frame; an improved safety liner comprising a base sheet extending beneath the bladder, sidewalls extending inwardly from said base sheet and forming a coffer containing the bladder, and an inflatable chamber joined to said sidewalls and extending continuously about said coffer, said inflatable chamber including inner and lower side portions disposed superjacently of the periphery of said bladder and being buoyantly supported thereby, such that said inflatable chamber is surrounded on two sides by said bladder.

2. The improved safety liner of claim 1, wherein the upper portions of said sidewalls are folded downwardly upon themselves and sealed thereto to form said inflatable chamber.

3. The improved safety liner of claim 1, wherein said sidewalls are supported in upwardly extending fashion by said buoyant support and free of any mechanical connection to said frame.

4. The improved safety liner of claim 1, including an inner panel joined to said sidewalls to define said inflatable chamber, a first seam joining the upper edge portions of said sidewalls to said inner panel, and a second seam joining a medial portion of said sidewalls to said inner panel.

5. The improved safety liner of claim 4, wherein said first and second seams are generally parallel, and said sidewalls and said inner panel are disposed in confronting relationship.

6. The improved safety liner of claim 1, wherein said inflatable chamber is pneumatically inflated to form a resilient tube extending about the edge of the waterbed.

7. The improved safety liner of claim 1, wherein said inflatable chamber is filled with resilient foam material.

8. In a waterbed including a liquid filled bladder disposed within a supporting frame; an improved safety liner comprising a base sheet extending beneath the bladder, sidewalls extending upwardly from said base sheet and forming a coffer containing the bladder, an inflatable chamber joined to said sidewalls and extending continuously about said coffer, said inflatable chamber impinging on the periphery of the bladder, an inner panel joined to said sidewalls to define said inflatable chamber, a first seam joining the upper edge portions of said sidewalls to said inner panel, a second seam joining a medial portion of said sidewalls to said inner panel, said sidewalls including distal portions extending inwardly from said first seam, said distal portions resting on the upper surface of said bladder.

9. The improved safety liner of claim 8, wherein said distal portions extend continuously about said sidewalls.

* * * * *